US011530821B2

(12) United States Patent
Yin et al.

(10) Patent No.: US 11,530,821 B2
(45) Date of Patent: Dec. 20, 2022

(54) INDOOR UNIT OF AIR CONDITIONER AND AIR CONDITIONER

(71) Applicants: QINGDAO HAIER AIR-CONDITIONING ELECTRONIC CO., LTD., Shandong (CN); HAIER SMART HOME CO., LTD., Shandong (CN)

(72) Inventors: Pengfei Yin, Shandong (CN); Shoubo Mao, Shandong (CN); Haisheng Wang, Shandong (CN); Zhongxiao Zhang, Shandong (CN); Wei Zhang, Shandong (CN); Guosheng Tang, Shandong (CN); Yanfang Cai, Shandong (CN)

(73) Assignees: QINGDAO HAIER AIR-CONDITIONING ELECTRONIC CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 144 days.

(21) Appl. No.: 17/258,493

(22) PCT Filed: Nov. 15, 2018

(86) PCT No.: PCT/CN2018/115670
§ 371 (c)(1),
(2) Date: Jan. 7, 2021

(87) PCT Pub. No.: WO2020/042372
PCT Pub. Date: Mar. 5, 2020

(65) Prior Publication Data

US 2021/0156572 A1 May 27, 2021

(30) Foreign Application Priority Data

Aug. 29, 2018 (CN) ..... 201810997068.X

(51) Int. Cl.
*F24F 1/0043* (2019.01)
*F24F 13/30* (2006.01)

(52) U.S. Cl.
CPC ..... *F24F 1/0043* (2019.02); *F24F 13/30* (2013.01)

(58) Field of Classification Search
CPC ..... F24F 1/0043; F24F 13/30; F24F 1/0068; F24F 1/00

(Continued)

(56) References Cited

U.S. PATENT DOCUMENTS 9,052,127 B2 * 6/2015 Lee ..... F25B 29/003
2006/0130514 A1 * 6/2006 Kim ..... F25D 29/005 62/446

(Continued)

FOREIGN PATENT DOCUMENTS

CN 2554530 6/2003
CN 1453535 11/2003

(Continued)

OTHER PUBLICATIONS

International Search Report and Written Opinion from PCT/CN2018/115670 dated May 16, 2019.

(Continued)

*Primary Examiner* — Steve S Tanenbaum
(74) *Attorney, Agent, or Firm* — Calfee, Halter & Griswold LLP

(57) ABSTRACT

The present disclosure discloses an indoor unit of an air conditioner and an air conditioner. The indoor unit of the air conditioner includes an indoor unit housing, a heat exchanger, a conduit and one or more storage parts provided outside the indoor unit housing and/or inside the indoor unit housing, wherein one end of the conduit is connected to a liquid separator of the heat exchanger, the other end of the (Continued)

conduit is connected to a gas collecting pipe of the heat exchanger, and the conduit is used for heat exchange with the one or more storage parts.

18 Claims, 3 Drawing Sheets

(58) Field of Classification Search
USPC ..... 62/452
See application file for complete search history.

(56) References Cited

U.S. PATENT DOCUMENTS

2011/0048059 A1* 3/2011 Song ..... F25D 19/006 62/515
2012/0047922 A1* 3/2012 Lee ..... F25D 23/061 62/89
2013/0160484 A1* 6/2013 Lee ..... F25D 16/00 62/440
2014/0290302 A1* 10/2014 Shin ..... F25D 11/022 62/419

FOREIGN PATENT DOCUMENTS

| | | | |
|---|---|---|---|
| CN | 201390178 | | 1/2010 |
| CN | 202048737 | | 11/2011 |
| CN | 202048737 U | * | 11/2011 |
| CN | 203442968 | | 2/2014 |
| CN | 204786761 | | 11/2015 |
| CN | 105180325 | | 12/2015 |
| CN | 105526635 | | 4/2016 |
| CN | 105526635 A | * | 4/2016 |
| CN | 207486962 | | 6/2018 |
| CN | 207599914 | | 7/2018 |
| KR | 2009004525 | | 4/2009 |

OTHER PUBLICATIONS

Office action from Chinese Application No. 201810997068.X dated Jun. 18, 2020.

* cited by examiner

INDOOR UNIT OF AIR CONDITIONER AND AIR CONDITIONER

CROSS-REFERENCE TO RELATED APPLICATIONS

The application is the national stage entry of PCT/CN2018/115670, filed on Nov. 15, 2018, which is based upon and claims priority to Chinese Patent Application No. 201810997068.X, filed Aug. 29, 2018, the entire contents of which are incorporated herein by reference.

TECHNICAL FIELD

The present disclosure relates to the field of air conditioner technologies, and more particularly, to an indoor unit of an air conditioner and an air conditioner.

BACKGROUND

At present, air conditioners are more and more indispensable household appliances in people's daily life. Conventional air conditioners are mainly used to realize cooling and heating functions of an indoor unit, and thus the functions are relatively single. With increasing requirements of users for the air conditioners, air conditioners with storage function have become a trend. The indoor unit of the existing storage type air conditioner is provided with a storage basket, and items in the storage basket are cooled or heated by cold air or hot air generated after performing heat exchange with a heat exchanger. Although the purpose of heating or cooling can be achieved, the use of the cold air or the hot air will be affected by an environment temperature, thereby resulting in poor cooling or heating effect.

SUMMARY

Embodiments of the present disclosure provide an indoor unit of an air conditioner and an air conditioner, so as to solve the problem that the indoor unit of the air conditioner has poor effect when cooling or heating are performed by the cold air or the hot air during storage. In order to have a basic understanding of some aspects of the disclosed embodiments, a brief summary is given below. This summary is not a general comment, nor is it intended to identify key/important constituent elements or describe the scope of protection of these embodiments. The sole purpose thereof is to present some concepts in a simplified form as a preface to the following detailed description.

According to a first aspect of the embodiments of the present disclosure, there is provided an indoor unit of an air conditioner, including an indoor unit housing, a heat exchanger, a conduit and one or more storage parts provided outside the indoor unit housing and/or inside the indoor unit housing, wherein one end of the conduit is connected to a liquid separator of the heat exchanger, the other end of the conduit is connected to a gas collecting pipe of the heat exchanger, and the conduit is used for heat exchange with the one or more storage parts.

Optionally, the storage part is a storage drawer, the indoor unit housing is provided with one or more installation openings, and the conduit is provided in a spiral shape at a position where the storage drawer is placed in the indoor unit housing, when the storage drawer is in a closed state, the storage drawer passes through the installation opening and is located in the indoor unit housing, and the conduit is wound and sleeved on an outer wall of the storage drawer.

Optionally, the conduit is uniformly wound and sleeved on the outer wall of the storage drawer, and there is a set distance between the conduit and the outer wall of the storage drawer.

Optionally, elastic buckles are provided on both end faces of the storage drawer, corresponding positions in the indoor unit housing are provided with grooves, and the elastic buckles are matched with the grooves.

Optionally, the indoor unit housing is provided with sliding rails at both sides of the installation opening, and the storage drawer is slidably connected to the sliding rails.

Optionally, the indoor unit of the air conditioner further includes a controller and a temperature sensor, wherein the temperature sensor is provided in the storage part, an electronic expansion valve is provided on the conduit, an input end of the controller is electrically connected to the temperature sensor for receiving temperature signals sent by the temperature sensor, and an output end of the controller is electrically connected to the electronic expansion valve for controlling an opening of the electronic expansion valve.

Optionally, the conduit includes a first pipe section and a second pipe section, the first pipe section exchanges heat with the storage part, and a layer of thermal insulation material is provided on an outer wall of the second pipe section.

Optionally, the storage part is provided in a space between the heat exchanger and an air outlet in the indoor unit housing.

Optionally, the indoor unit of the air conditioner is a vase-shaped indoor unit of the air conditioner, the vase-shaped indoor unit includes a base, a main housing and a head and neck portion, the base, the main housing and the head and neck portion are sequentially connected from bottom to top to form a vase structure, the heat exchanger is provided in the main housing, the air outlet is provided on the main housing, and the storage part is provided in the main housing.

According to a second aspect of the embodiments of the present disclosure, there is provided an air conditioner, including the above-mentioned the indoor unit of the air conditioner.

Some technical solutions provided by the embodiments of the present disclosure may achieve following technical effects.

It is beneficial to a circulation of the refrigerant by connecting the conduit to the gas collecting pipe and the liquid separator of the heat exchanger respectively to form a loop with the heat exchanger. When the air conditioner is in a cooling working condition, the temperature of the refrigerant flowing through the heat exchanger (an evaporator) drops sharply due to the increase in space, and the decrease in pressure, at this time, the heat exchange is performed with the storage part through the conduit to cool the storage part; and when the air conditioner is in a heating working condition, the refrigerant flowing through the heat exchanger (a condenser) is a high-temperature and high-pressure liquid, at this time, the heat exchange is performed with the storage part through the conduit to heat the storage part, and is not easily affected by the environment temperature, thereby improving the cooling or heating effect.

It should be understood that both the foregoing general description and the following detailed description are exemplary and explanatory only and are not intended to limit the present disclosure.

BRIEF DESCRIPTION OF THE DRAWINGS

The accompanying drawings, which are incorporated in and constitute a part of this description, illustrate embodiments consistent with the present disclosure and, together with the description, serve to explain the principles of the present disclosure.

DESCRIPTION OF REFERENCE SIGNS

Figure 1:
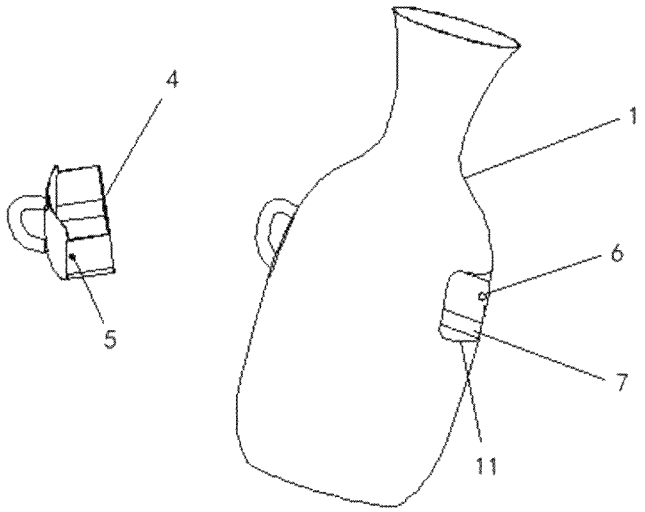
FIG. 1 is an elevation view illustrating an indoor unit of an air conditioner according to an exemplary embodiment.

1. indoor unit housing; 11. installation opening; 12. base; 13. main housing; 14. head and neck portion; 2. heat exchanger; 21. liquid separator; 22. gas collecting pipe; 3. conduit; 4. storage drawer; 5. elastic buckle; 6. groove; 7. sliding rail; 8. air outlet; 9. electronic expansion valve.

DETAILED DESCRIPTION

The following description and accompanying drawings fully illustrate the specific implementation solutions of the present disclosure so that a person skilled in the art can practice them. The embodiments merely represent possible changes. Unless otherwise specified explicitly, the individual component and function are optional and the operation sequence may be changed. Parts and characteristics of some implementation solutions may be included in or replace parts and characteristics of other implementation solutions. The scope of the implementation solutions of the present disclosure includes the whole scope of the claims and all available equivalents of the claims. As used herein, each implementation solution may be independently or generally expressed by "present disclosure", which is merely for convenience. As a matter of fact, if more than one disclosure is disclosed, it does not mean that the scope of the application is automatically limited to any single disclosure or disclosure concept. As used herein, terms such as "first" and "second" are merely for distinguishing one entity or operation from another entity or operation and do not require or imply any actual relationship or sequence among these entities or operations.

It should be noted that all directional indications (such as up, down, left, right, front, rear, . . . ) in the embodiments of the present application are only used to explain the relative position relationship, the movement, etc. between the components in a specific posture (as shown in the attached drawings). If the specific posture is changed, the directional indication will be changed accordingly. In addition, the descriptions of "first", "second", etc. in this application are used for descriptive purposes only, and are not to be construed as indicating or implying their relative importance or implicitly indicating the number of technical features indicated. Thus, features defining "first" or "second" may include at least one of the features, either explicitly or implicitly.

In the present application, it should be noted that the terms "installed", "connected", etc. should be understood broadly, unless otherwise explicitly stated and defined. For example, "connected" may be a fixed connection, or may be a detachable connection, or may be integrated; it may be a mechanical connection or an electrical connection; it may be directly connected or indirectly connected through an intermediate medium, and may be an internal connection of two elements. For a person having ordinary skill in the art, the specific meanings of the above terms in the present application may be understood on a case-by-case basis.

The embodiments in the present application are all described in a progressive manner, each embodiment focuses on a difference from other embodiments, and for same or similar parts in the embodiments, refer to these embodiments.

According to the first aspect of the embodiments of the present application, as shown in FIG. 1 to FIG. 6, there is provided an indoor unit of an air conditioner, including an indoor unit housing 1, a heat exchanger 2, a conduit 3 and one or more storage parts provided outside the indoor unit housing 1 and/or inside the indoor unit housing 1, wherein one end of the conduit 3 is connected to a liquid separator 21 of the heat exchanger 2, the other end of the conduit 3 is connected to a gas collecting pipe 22 of the heat exchanger 2, and the conduit 3 is used for heat exchange 2 with the one or more storage parts.

In this embodiment, the position of the storage part is not particularly limited. The storage part can be provided inside or outside the indoor unit housing 1. If the storage part is provided inside the indoor unit housing 1, a certain amount of space can be saved, and the space of the indoor unit of the air conditioner can be used efficiently; and if the storage part is provided outside the indoor unit housing 1, there is no effect on the internal structure of the indoor unit of the air conditioner, that is, there is no need to change the internal structure of the indoor unit of the air conditioner, as long as the storage part is connected to the heat exchanger 2 through the conduit 3, to realize the heat exchange of the refrigerant flowing through the storage part. The storage part can be a storage drawer 4 or a storage room (similar to the structure of a refrigerating chamber of a refrigerator) for storing the items. The shape of the storage part can be appropriately adjusted according to the shape of the indoor unit housing 1. For better heat exchange effect, the conduit 3 can be made of metal, preferably copper, the storage part is respectively connected to the gas collecting pipe 22 and the liquid separator 21 of the heat exchanger 2 through the conduit 3 to form a loop with the heat exchanger 2, which is beneficial to the circulation of refrigerant. When the air conditioner is in a cooling working condition, the temperature of the refrigerant flowing through the heat exchanger 2 (an evaporator) drops sharply due to the increase in space, and the decrease in pressure, at this time, the heat exchange is performed with the storage part through the conduit 3 to cool the storage part; and when the air conditioner is in a heating working condition, the refrigerant flowing through the heat exchanger 2 (a condenser) is a high-temperature and high-pressure liquid, at this time, the heat exchange is performed with the storage part through the conduit 3 to heat the storage part. When the indoor unit of the air conditioner includes a plurality of storage parts, one of the plurality of storage parts may be provided inside the indoor unit housing 1, and other storage parts may be provided outside the indoor unit housing 1, or all the storage parts can be provided outside or inside the indoor unit housing 1.

There are many ways to exchange heat between the conduit 3 and the storage part. The conduit 3 can be wound around an outer wall of the storage part, or around an inner wall of the storage part; or the conduit 3 can also be provided between the inner wall and the outer wall of the storage part in a spiral shape, circuitous or circuitous distribution.

Figure 2:
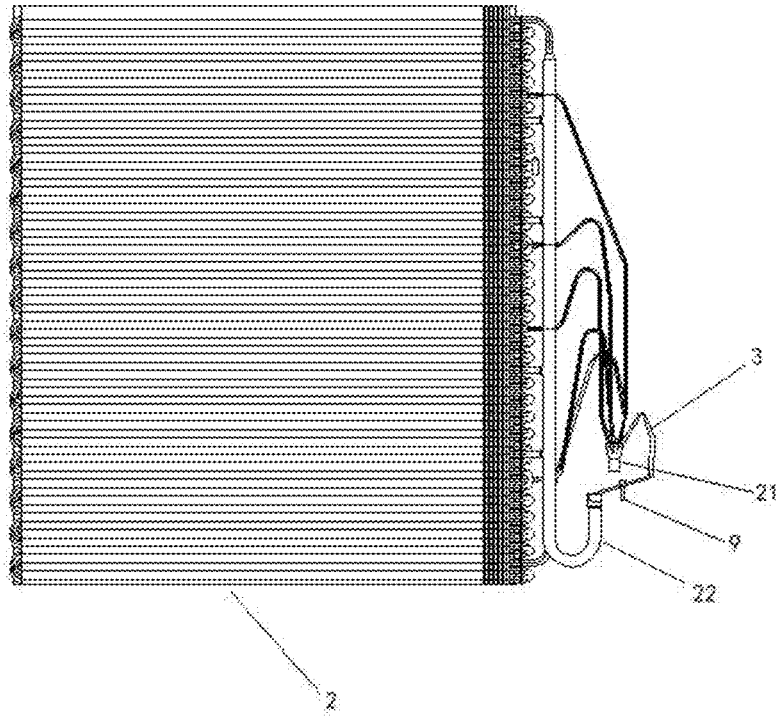
FIG. 2 is a schematic diagram illustrating a connection structure between a conduit and a heat exchanger according to an exemplary embodiment.

In an optional embodiment, as shown in FIG. 1 and FIG. 2, the storage part is a storage drawer 4, the indoor unit housing 1 is provided with one or more installation openings 11, and the conduit 3 is provided in the spiral shape at a position where the storage drawer 4 is placed in the indoor unit housing 1.

When the storage drawer 4 is in a closed state, the storage drawer 4 passes through the installation opening 11 and is located in the indoor unit housing 1, and the conduit 3 is wound and sleeved on an outer wall of the storage drawer 4.

In this embodiment, the storage drawer 4 is easy to draw, and the stored items can be put in and taken out. In summer, drinks can be put in the storage drawer 4 to have the effect of the refrigerator, and in winter, the drinks can be heated to a certain extent. The arrangement of the conduit 3 is to increase the contact area with the storage drawer 4, thereby improving the efficiency of the heat exchange and making full use of the refrigerant. Specifically, a supporting frame adapted to the storage drawer 4 can be provided in the indoor unit housing 1, one end of the supporting frame is fixed on the indoor unit housing 1 at the installation opening 11, and the conduit 3 is provided in the spiral shape on the supporting frame. The indoor unit housing 1 at the position of the installation opening 11 can also be made into a concave shape adapted to the storage drawer 4, and the conduit 3 is provided in the spiral shape on the concave shape housing. When the storage drawer 4 is in the closed state, the conduit 3 is wound around the outer wall of the storage drawer 4 to exchange heat with the storage drawer 4. The spiral extension direction of the conduit 3 is the same as a push-pull direction of the storage drawer 4. That is, the spiral axis direction is the same as the push-pull direction of the storage drawer 4.

In an optional embodiment, the conduit 3 is uniformly wound and sleeved on the outer wall of the storage drawer 4, and there is a set distance between the conduit 3 and the outer wall of the storage drawer 4.

In this embodiment, a certain distance is set between the conduit 3 and the storage drawer 4 to avoid friction between the storage drawer 4 and the conduit 3 during a drawing process. Certainly, the heat exchange between the conduit 3 and the storage drawer 4 will be affected if the set distance is too long, the set distance can be 1 mm to 5 mm, or other values, which is not specifically limited here.

In an optional embodiment, as shown in FIG. 1, elastic buckles 5 are provided on both end faces of the storage drawer 4, corresponding positions in the indoor unit housing 1 are provided with grooves 6, and the elastic buckles 5 are matched with the grooves 6. When the storage drawer 4 is in the closed state, the storage drawer 4 may be partially pulled out of the indoor unit housing 1 due to the influence of external force, and the temperature in the storage drawer 4 may be affected by the indoor environment temperature. After the grooves 6 are provided, when the storage drawer 4 completely enters the indoor unit housing, the elastic buckles 5 on both sides will be clamped in the grooves 6 thereby locking the storage drawer 4.

In an optional embodiment, as shown in FIG. 1, sliding rails 7 are provided on both sides of the installation opening 11 in the indoor unit housing 1, and the storage drawer 4 is slidably connected to the sliding rails 7. In this embodiment, the arrangement of the sliding rail 7 is beneficial to the push and pull of the storage drawer 4 in the indoor unit housing 1, and the length direction of the sliding rail 7 is consistent with the push-pull direction of the storage drawer 4. The sliding rail 7 can be selected as a sliding chute, and both end faces of the storage drawer 4 are provided with protrusions matched with the sliding chute. The protrusions on the both end faces of the storage drawer 4 are placed in the sliding chute during installation, and the storage drawer 4 can be pushed and pulled freely.

There are many ways to assemble the storage part with the indoor unit housing 1. In addition to the push-pull sliding rail structure of the storage drawer 4 in the above embodiment, a flat-open structure can also be adopted. The storage part is provided in the indoor unit housing 1 in the form of the storage room, and a door of the storage room is hinged on the indoor unit housing 1. The items in the storage room can be taken out and put in by opening the door.

Figure 3:
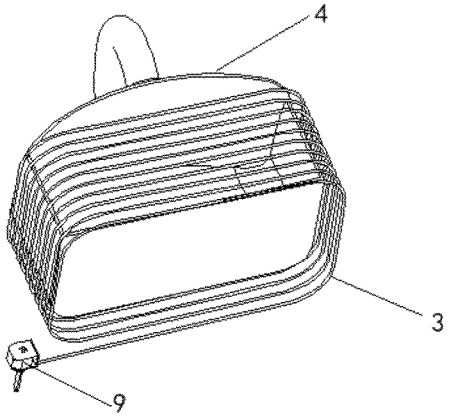
FIG. 3 is a schematic diagram illustrating a structure between a conduit and a storage part according to an exemplary embodiment.

In an optional embodiment, as shown in FIG. 3, the indoor unit of the air conditioner further includes a controller and a temperature sensor (not shown in FIG. 3). The temperature sensor is provided in the storage part, an electronic expansion valve 9 is provided on the conduit 3, an input end of the controller is electrically connected with the temperature sensor for receiving temperature signals sent by the temperature sensor, and an output end of the controller is electrically connected to the electronic expansion valve 9 for controlling an opening of the electronic expansion valve 9.

In this embodiment, the fine control of the internal temperature of the storage drawer 4 can be realized. The temperature sensor is provided in the storage drawer 4 to obtain the real-time temperature, and then the opening of the electronic expansion valve 9 is controlled by the controller to adjust the flow rate of refrigerant in the conduit 3. The user can set a temperature value in advance, and the controller will determine whether the temperature value reaches the preset temperature value according to the received real-time temperature signal. If the difference between the temperature value and the preset temperature value is relatively large, the opening of the electronic expansion valve 9 is increased to increase the flow rate of refrigerant; and if the difference is relatively small, the opening of the electronic expansion valve 9 is decreased to reduce the flow rate of refrigerant, finally, the cooling or heating requirements of the user are realized. The temperature sensor can be a PT100 platinum resistance temperature sensor, and the controller can be a YR-E16 controller.

In an optional embodiment, the conduit 3 includes a first pipe section and a second pipe section, wherein the first pipe section exchanges heat with the storage part, and a layer of thermal insulation material is provided on an outer wall of the second pipe section. By providing the thermal insulation material, the heat exchange between the refrigerant and the outside during the circulation of the conduit 3 can be effectively reduced, and the efficiency of the heat exchange between the refrigerant and the storage drawer 4 can be improved. The thermal insulation material can be thermal insulation cotton with good thermal insulation effect and low cost.

Figure 4:
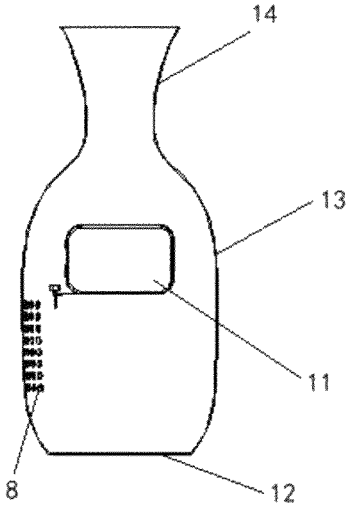
FIG. 4 is a left view illustrating an indoor unit of an air conditioner according to an exemplary embodiment.
Figure 5:
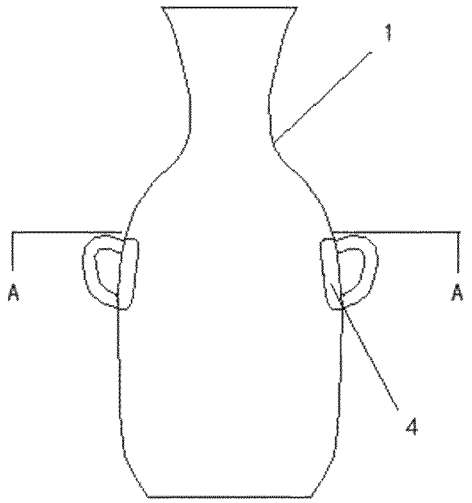
FIG. 5 is a front view illustrating an indoor unit of an air conditioner according to an exemplary embodiment.
Figure 6:
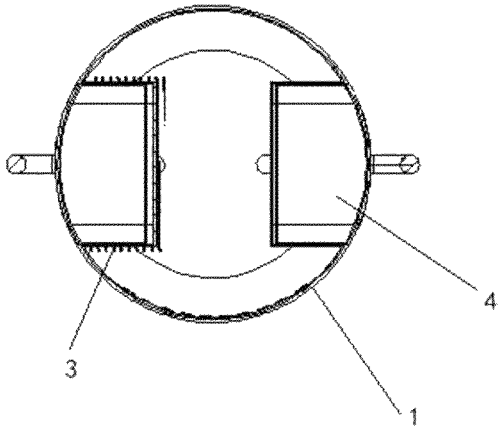
FIG. 6 is a section view taken along A-A in FIG. 5.

In an optional embodiment, as shown in FIG. 4, the storage part is provided in a space between the heat exchanger 2 and an air outlet 8 in the indoor unit housing 1. The position of the storage part does not affect the overall structure of the indoor unit of the air conditioner, and is beneficial to improve the space utilization rate of the indoor unit of the air conditioner.

In an optional embodiment, as shown in FIG. 4, the indoor unit of the air conditioner is a vase-shaped indoor unit of the air conditioner, the vase-shaped indoor unit 1 includes a base 12, a main housing 13 and a head and neck portion 14, the base 12, the main housing 13 and the head and neck portion 14 are sequentially connected from bottom to top to form a vase structure, the heat exchanger 2 is provided in the main housing 13, the air outlet 8 is provided on the main housing 13, and the storage part is provided in the main housing 13.

In this embodiment, a vase-shaped air conditioner is mainly used in hotel halls and large conference rooms, which requires relatively high overall aesthetics. Providing the storage part in the main housing will not affect the overall aesthetics. When two storage parts are provided on the main housing 13, two storage drawers 4 can be provided, and handles are provided on the storage drawers 4 to facilitate the push and pull of the storage drawers 4. The storage drawer 4 is provided in a shape matching the streamlined main housing 13, so that the storage drawer 4 and the main housing 13 appear to be a whole from the appearance.

According to the second aspect of the embodiments of the present application, there is provided an air conditioner, including the above-mentioned indoor unit of the air conditioner.

Since the air conditioner includes the indoor unit of the air conditioner that has the storage function and can cool or heat the items seasonally, the functions of the air conditioner are enriched, and the utilization rate of the refrigerant is improved, so that the refrigerant can not only realize the cooling or heating of the indoor unit, but also cool or heat the items, thereby having some functions of the refrigerator, and accurately adjusting the temperature of the items in the storage drawers.

The descriptions about the above embodiments are merely provided to help understand the method and core ideas of the present disclosure. In addition, persons of ordinary skill in the art can make variations to the present disclosure in terms of the specific implementations and application scopes according to the ideas of the present disclosure. Therefore, the content of the specification shall not be understood as a limit to the present disclosure.

What is claimed is:

1. An indoor unit of an air conditioner, comprising an indoor unit housing, a heat exchanger, a conduit and one or more storage parts, wherein one end of the conduit is connected to a liquid separator of the heat exchanger, the other end of the conduit is connected to a gas collecting pipe of the heat exchanger, and the conduit is configured to exchange heat with the one or more storage parts; wherein the indoor unit of the air conditioner is a vase-shaped indoor unit of the air conditioner, the vase-shaped indoor unit comprises a base, a main housing and a head and neck portion, and the base, the main housing and the head and neck portion are sequentially connected from bottom to top to form a vase structure.

2. An air conditioner, comprising the indoor unit of the air conditioner according to claim 1.

3. The indoor unit of the air conditioner according to claim 1, further comprising a controller and a temperature sensor, wherein the temperature sensor is provided in the one or more storage parts, an electronic expansion valve is provided on the conduit, an input end of the controller is electrically connected to the temperature sensor for receiving temperature signals sent by the temperature sensor, and an output end of the controller is electrically connected to the electronic expansion valve for controlling an opening of the electronic expansion valve.

4. An air conditioner, comprising the indoor unit of the air conditioner according to claim 3.

5. The indoor unit of the air conditioner according to claim 1, wherein the conduit comprises a first pipe section and a second pipe section, the first pipe section exchanges heat with the one or more storage parts, and a layer of thermal insulation material is provided on an outer wall of the second pipe section.

6. An air conditioner, comprising the indoor unit of the air conditioner according to claim 5.

7. The indoor unit of the air conditioner according to claim 1, wherein the one or more storage parts are one or more storage drawers, the indoor unit housing is provided with one or more installation openings, and the conduit is provided in a spiral shape at a position where the one or more storage drawers are placed in the indoor unit housing, when the one or more storage drawers are in a closed state, the one or more storage drawers pass through the one or more installation openings and are located in the indoor unit housing, and the conduit is wound and sleeved on an outer wall of the one or more storage drawer.

8. An air conditioner, comprising the indoor unit of the air conditioner according to claim 7.

9. The indoor unit of the air conditioner according to claim 7, wherein the conduit is uniformly wound and sleeved on the outer wall of the one or more storage drawers, and there is a set distance between the conduit and the outer wall of the one or more storage drawers.

10. An air conditioner, comprising the indoor unit of the air conditioner according to claim 9.

11. The indoor unit of the air conditioner according to claim 7, wherein elastic buckles are provided on two end faces of each of the storage drawers, corresponding positions in the indoor unit housing are provided with grooves, and the elastic buckles are matched with the grooves.

12. An air conditioner, comprising the indoor unit of the air conditioner according to claim 11.

13. The indoor unit of the air conditioner according to claim 7, wherein the indoor unit housing is provided with sliding rails at two sides of each of the one or more installation openings, and the one or more storage drawers are slidably connected to the sliding rails.

14. An air conditioner, comprising the indoor unit of the air conditioner according to claim 13.

15. The indoor unit of the air conditioner according to claim 1, wherein the one or more storage parts are provided in one or more spaces between the heat exchanger and an air outlet in the indoor unit housing.

16. An air conditioner, comprising the indoor unit of the air conditioner according to claim 15.

17. The indoor unit of the air conditioner according to claim 15, wherein the heat exchanger is provided in the main housing, the air outlet is provided on the main housing, and the one or more storage parts are provided in the main housing.

18. An air conditioner, comprising the indoor unit of the air conditioner according to claim 17.

* * * * *